US008740190B2

(12) United States Patent
Tijerina

(10) Patent No.: US 8,740,190 B2
(45) Date of Patent: Jun. 3, 2014

(54) VEHICLE SUPPORT ASSEMBLY AND METHOD OF USING SAME

(76) Inventor: Raul Tijerina, Tonopah, AZ (US)

( * ) Notice: Subject to any disclaimer, the term of this patent is extended or adjusted under 35 U.S.C. 154(b) by 243 days.

(21) Appl. No.: 13/434,103

(22) Filed: Mar. 29, 2012

(65) Prior Publication Data

US 2013/0256610 A1 Oct. 3, 2013

(51) Int. Cl.
*B66F 3/14* (2006.01)

(52) U.S. Cl.
USPC ..... 254/108; 254/96; 254/98; 254/100; 254/134

(58) Field of Classification Search
CPC ..... B66F 3/06; B66F 3/14; B66F 2700/02
USPC ..... 254/108, 96, 98, 100, 97, 134, 92, 3 R
See application file for complete search history.

(56) References Cited

U.S. PATENT DOCUMENTS

| | | | | | |
|---|---|---|---|---|---|
| 696,613 | A | * | 4/1902 | Waslyng | 254/43 |
| 734,554 | A | * | 7/1903 | Herbert | 269/200 |
| 763,344 | A | * | 6/1904 | Bryant et al. | 182/132 |
| 943,361 | A | * | 12/1909 | Mayer | 600/238 |
| 1,427,964 | A | * | 9/1922 | Marquiss | 254/29 R |
| 1,822,969 | A | * | 9/1931 | Johnson | 254/108 |
| 2,355,341 | A | * | 8/1944 | Trimbach | 414/728 |
| 2,501,603 | A | * | 3/1950 | Howard | 254/108 |
| 2,802,248 | A | * | 8/1957 | Wallace | 24/68 B |
| 3,334,866 | A | * | 8/1967 | Bergamino | 254/108 |
| 3,352,539 | A | * | 11/1967 | Witt | 410/23 |
| 3,737,146 | A | * | 6/1973 | Potter et al. | 254/108 |
| 3,994,475 | A | * | 11/1976 | Chambers | 254/108 |
| 4,013,267 | A | * | 3/1977 | Kirk | 254/85 |
| 4,589,630 | A | | 5/1986 | Arzouman | |
| 4,792,121 | A | * | 12/1988 | Annas, Sr. et al. | 254/95 |
| 5,098,065 | A | * | 3/1992 | Beletich | 254/1 |
| 5,947,449 | A | * | 9/1999 | Dube et al. | 254/134 |
| 5,979,876 | A | * | 11/1999 | Cardona | 254/108 |
| 6,565,068 | B1 | | 5/2003 | Arzouman | |
| 6,601,827 | B1 | | 8/2003 | Arzouman | |
| 7,011,296 | B2 | | 3/2006 | Arzouman | |
| 7,168,685 | B2 | | 1/2007 | Miner | |
| 7,389,970 | B2 | * | 6/2008 | Ruan | 254/108 |
| 7,413,166 | B2 | | 8/2008 | Arzouman | |
| 7,434,782 | B2 | * | 10/2008 | Arzouman | 254/8 B |
| 7,648,121 | B2 | | 1/2010 | Arzouman | |
| 7,900,890 | B2 | * | 3/2011 | Imase | 254/96 |
| 2007/0170407 | A1 | * | 7/2007 | Ruan | 254/108 |

(Continued)

*Primary Examiner* — George Nguyen
(74) *Attorney, Agent, or Firm* — Schmeiser, Olsen & Watts LLP; Jordan M. Meschkow; Charlene R. Jacobsen

(57) ABSTRACT

A support assembly includes a frame, a first ratchet, a second ratchet, a lift structure, a bridge member, and a saddle. Each of the first and second ratchets includes a linear rack attached to first and second side members of the frame, and a slide structure slideably mounted with one of the side members. Each slide structure includes a pawl that successively engages with teeth in the linear rack as the lift structure of the support assembly is extended upwardly and as the slide structure slides along the linear rack. The support assembly may be a jack stand that is co-located with a vehicle jack. A head of the vehicle jack pushes against a bottom surface of the bridge member of the jack stand to cause the lift structure to extend upwardly and the ratchet systems to engage in a locked position to hold a vehicle in a raised position.

20 Claims, 6 Drawing Sheets

(56) References Cited

U.S. PATENT DOCUMENTS

2008/0099745 A1 5/2008 Arzouman
2008/0290332 A1 11/2008 Zetterlund
2009/0242862 A1 10/2009 Walton
2009/0283733 A1 11/2009 Lyashevskiy et al.
2010/0044656 A1* 2/2010 Imase ..... 254/96

* cited by examiner

FIG. 8
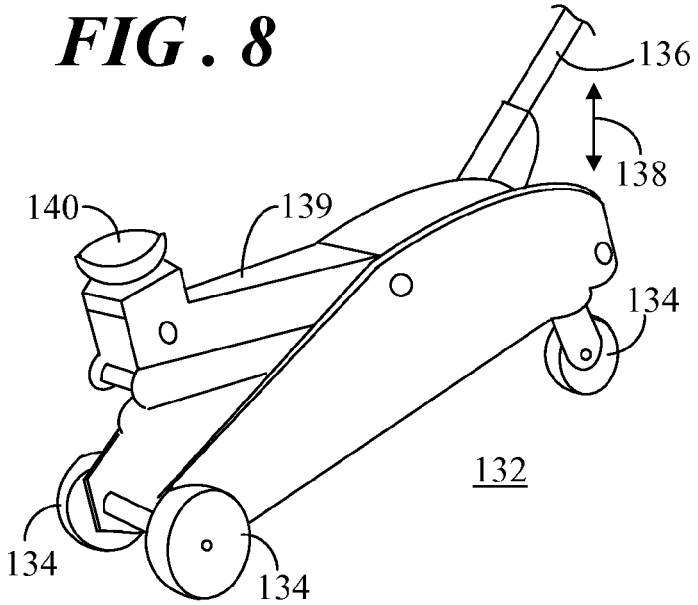
FIG. 10
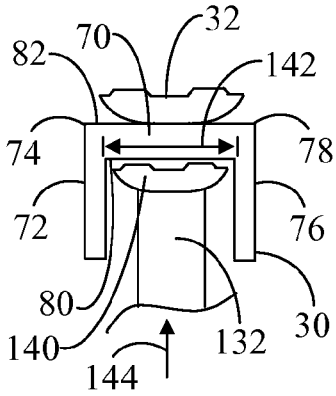
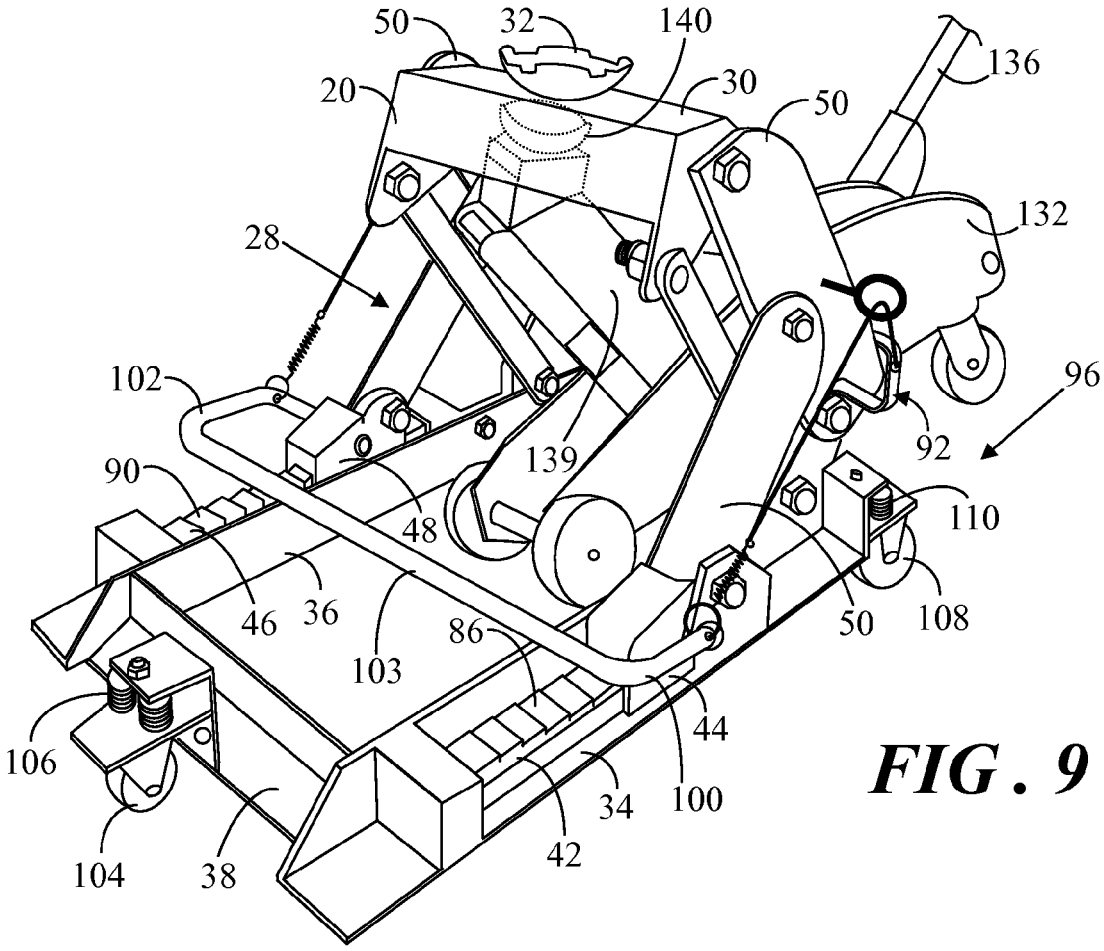
FIG. 9

VEHICLE SUPPORT ASSEMBLY AND METHOD OF USING SAME

TECHNICAL FIELD OF THE INVENTION

The present invention relates generally to support assemblies for lifting and supporting a vehicle. More specifically, the present invention relates to a jack stand for use with a vehicle jack at a common jacking location.

BACKGROUND OF THE INVENTION

Elevating a portion of a vehicle often involves using a jack. Typically, the jack is placed under a portion of the frame of the automobile and the jack is slowly raised until a platform on the jack engages the frame of the automobile. Thereafter, a user uses the principle of leverage to elevate a portion of the frame.

Sometimes a vehicle needs to remain supported while a user repairs a portion of the vehicle that is only accessible from the bottom. Most standard floor jacks are movable, so that the jack may be readily repositioned at different portions of the frame. As such, a vehicle supported solely by a jack without some type of loading device may be unstable and unsafe to work underneath. When hydraulic jacks are used, there additionally exists an ongoing potential for failure of the jack during operation. Since the jack has moving parts, each moving part is subject to wear. In particular, the hydraulic system is subject to deterioration in the cylinder, the valves, and any other parts of the jack that are directly used to support the vehicle during lifting. Due to the potential for movement and especially for hydraulic failure of the jack, floor jacks are generally not intended to be used as a sole support means for items such as automobiles. Instead, a user may place one or more jack stand under the frame and lower the floor jack so that the vehicle is supported on the jack stand instead of the jack itself while working beneath the vehicle.

Jack stands are intended to replace floor jacks that have previously raised the object to a desired height. With older model vehicles, the user would simply jack up a portion of the vehicle using the frame as a contact point, and place the desired jack stand underneath the frame of the vehicle. However, as unibody construction has become more prevalent on vehicles, there are now fewer points with which jack stands can be used. The typical unibody automobile provides specific reinforced locations for the use of a floor jack. For example, on many automobiles, only a single reinforced vehicle contact point for a jack is defined along the side of many unibody automobile designs.

A jack stand and a jack typically cannot support a vehicle at the same location on the frame because they have individual and separate support structures. This can cause a problem in the unibody design where a manufacturer designates only certain contact locations. Accordingly, while a jack stand is usually more stable than a jack, the jack stand cannot support the vehicle at the same point that is occupied by the jack. As a result, the jack stand often must be placed a considerable distance away from the jacking location in order to find a portion of the undercarriage that is compatible with the top of the support platform. This causes a situation in which a higher jacking elevation may be required to accommodate the jack stand location and/or causes a scenario in which the jack stand is placed at an unsuitable location.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 8 shows a side perspective view of a floor jack;

FIG. 9 shows a side perspective view of the support assembly in use with the floor jack of FIG. 8;

FIG. 10 shows an enlarged side view of a portion of a bridge member of the support assembly;

DETAILED DESCRIPTION

Embodiments entail a support assembly for use when a portion of a vehicle is to be raised. In an embodiment, the support assembly is in the form of a jack stand that may be used with a vehicle jack at a common location underneath the vehicle. The jack stand is a low profile structure that can readily fit underneath cars and is compatible with contemporary vehicle jacks, such as scissor jacks, floor jacks, racing jacks, and the like. The jack stand includes a dual ratchet system that serves as a secure lock mechanism for retaining the jack stand in an extended position. In another embodiment, the support assembly is a floor jack having the dual ratchet system so that the floor jack can be securely locked in an extended position. Yet another embodiment entails a method of raising a portion of a vehicle using the support assembly.

Figure 1:
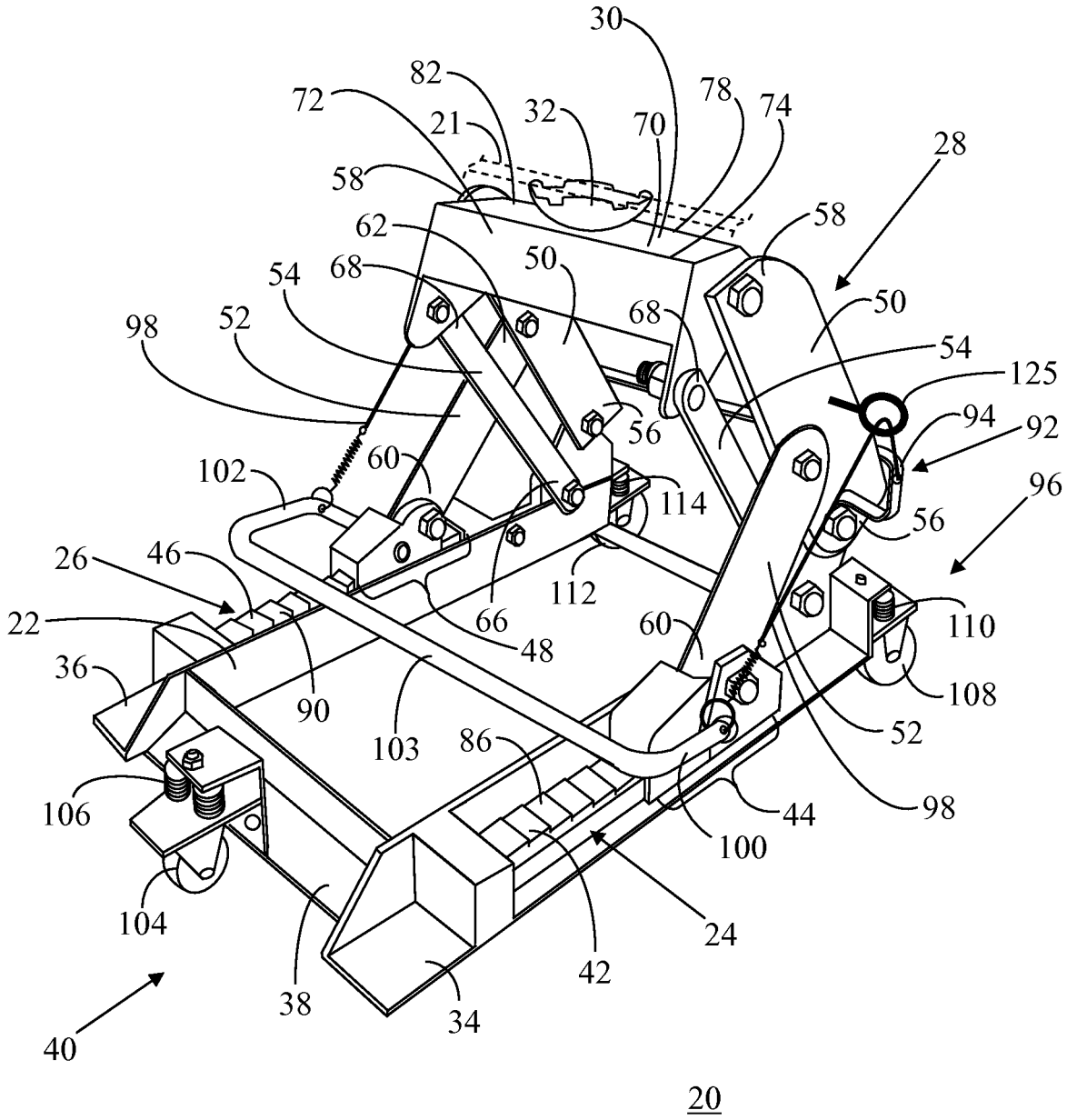
FIG. 1 shows a side perspective view of a support assembly in accordance with an embodiment.
Figure 2:
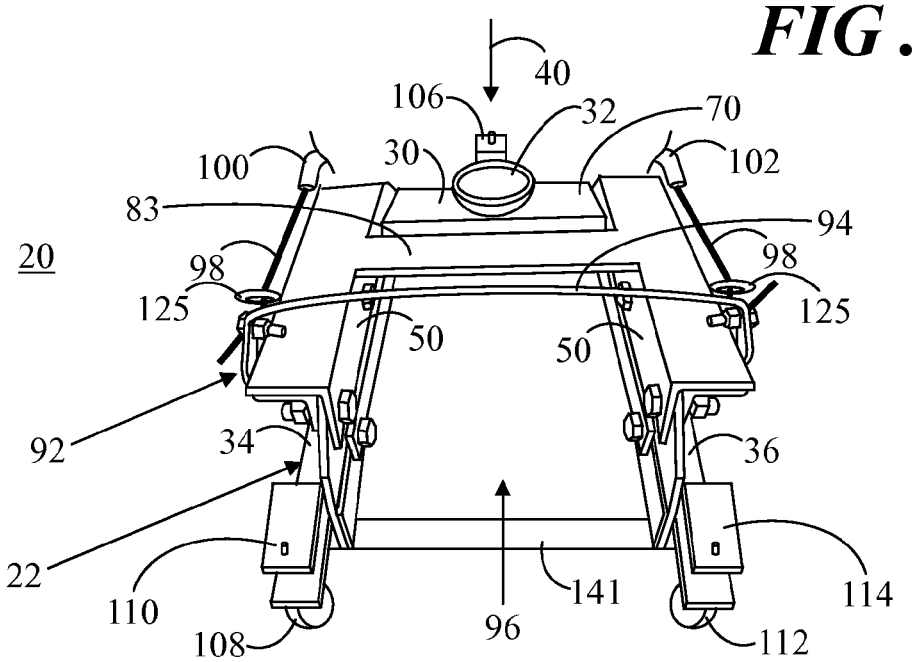
FIG. 2 shows a rear perspective view of the support assembly of FIG. 1.
Figure 3:
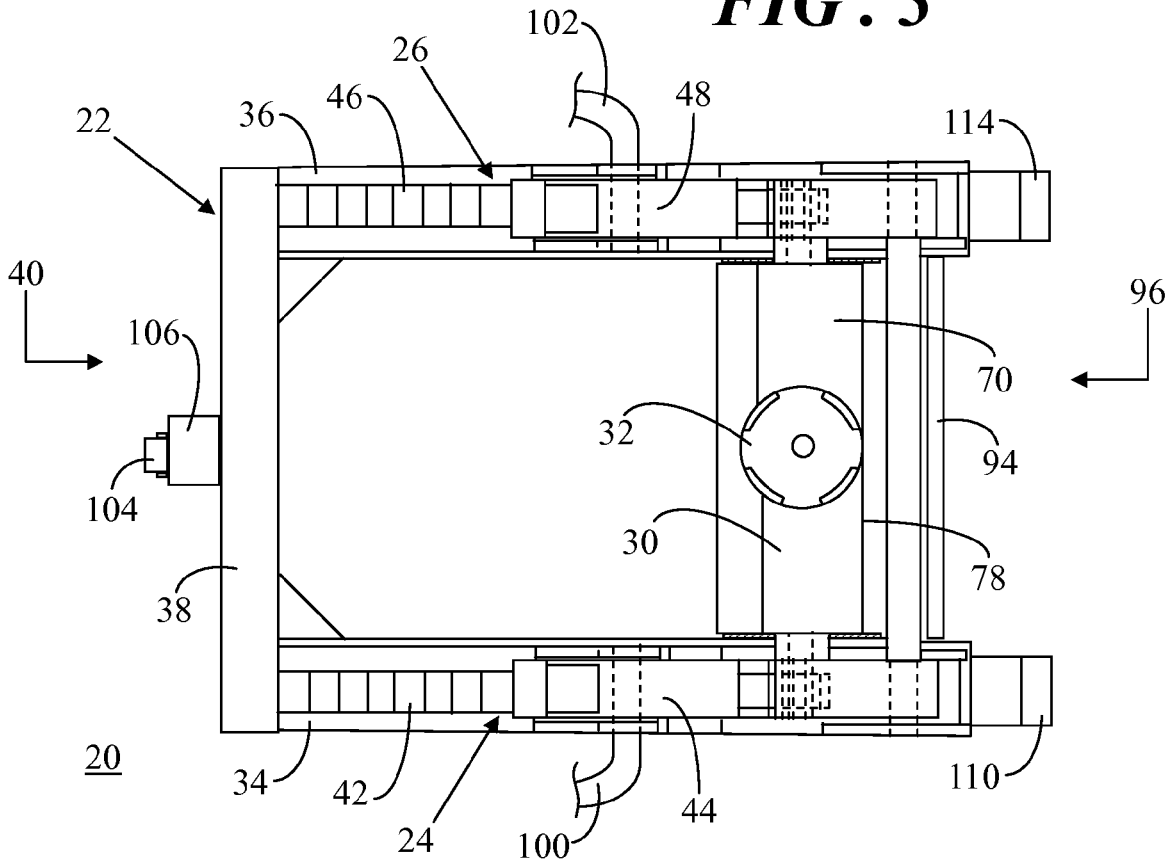
FIG. 3 shows a top view of the support assembly.

Referring to FIGS. 1-3, FIG. 1 shows a side perspective view of a support assembly 20 in accordance with an embodiment, FIG. 2 shows a rear perspective view of support assembly 20, and FIG. 3 shows a top view of support assembly 20. Support assembly 20 is a jack stand used to support a vehicle 21 (represented in dashed line form in FIG. 1) after vehicle 21 has been raised using a vehicle jack, such as a floor jack, co-located with support assembly 20 (discussed below). As such, support assembly 20 is referred to hereinafter as jack stand 20. Jack stand 20 generally includes a frame 22, a first ratchet system 24, a second ratchet system 26, a lift structure 28, a bridge member 30, and a saddle 32.

Frame 22 includes a first side member 34 spaced apart from a second side member 36. First and second side members 34 and 36, respectively, are interconnected via a cross member 38 located at a forward side 40 of frame 22. Cross member 38 is oriented approximately orthogonal to first and second side members 34 and 36. First and second side members 34 and 36 and cross member 38 may be formed from iron, such as angle iron, that is welded, bolted, or otherwise fastened together.

First ratchet system 24 includes a first linear rack 42 attached to and aligned with first side member 34 and further includes a first slide structure 44 overlying first linear rack 42 and slideably mounted with first side member 34. Likewise, second ratchet system 26 includes a second linear rack 46 attached to and aligned with second side member 36 and further includes a second slide structure 48 overlying second linear rack 46 and slideably mounted with second side member 36.

As best shown in FIG. 1, lift structure 28 includes a pair of lift arms 50, a pair of connecting arms 52, and a pair of connecting links 54. Each of lift arms 50 includes a first end 56 and a second end 58. First end 56 of each lift arm 50 is pivotally coupled to one of first and second side members 34 and 36, respectively. In addition, second end 58 of each lift arm 50 is pivotally coupled to bridge member 30. Each of connecting arms 52 includes a third end 60 and a fourth end 62. Third end 60 of each connecting arm 52 is pivotally coupled to one of first and second slide structures 44 and 48, respectively. In addition, fourth end 62 of each connecting arm 52 is pivotally coupled to one of lift arms 50. Connecting links 54 are oriented substantially parallel to lift arms 50. Each of connecting links 54 includes a fifth end 66 and a sixth end 68. Fifth end 66 of each connecting link 54 is pivotally coupled to one of first and second side members 34 and 36, respectively. In addition sixth end 68 of each connecting link 54 is pivotally coupled to bridge member 30.

Lift structure 28 has a bottom end, namely third end 60 of each connecting arm 52, that is pivotally coupled with one of first and second slide structures 44 and 48. Lift structure 28 additionally has a top end, namely, second end 58 of each lift arm 50 and sixth end 68 of each connecting link 54, that is pivotally coupled to bridge member 30. The arrangement and various pivotal attachments of lift arms 50, connecting arms 52, and connecting links 54 causes bridge member 30 and consequently saddle 32 to pivot and thus remain approximately horizontal as lift structure 28 moves from a stowed position to an extended position.

In an embodiment, bridge member 30 includes a support plate 70, a first sidewall 72 downwardly extending from a front edge 74 of support plate 70, and a second sidewall 76 (see FIG. 10) downwardly from a rear edge 78 (see FIG. 10) of support plate 70. Support plate 70 includes a lower surface 80 (see FIG. 10) and an upper surface 82. Saddle 32 is welded, bolted, or otherwise fastened to upper surface 82 of bridge member 30. In the embodiment shown in FIG. 2, lift arms 50 may be connected to one another via a cross member 83 to largely prevent side-to-side movement of lift arms 50. Cross member 83, however, is not directly coupled to bridge member 30.

Figure 6:
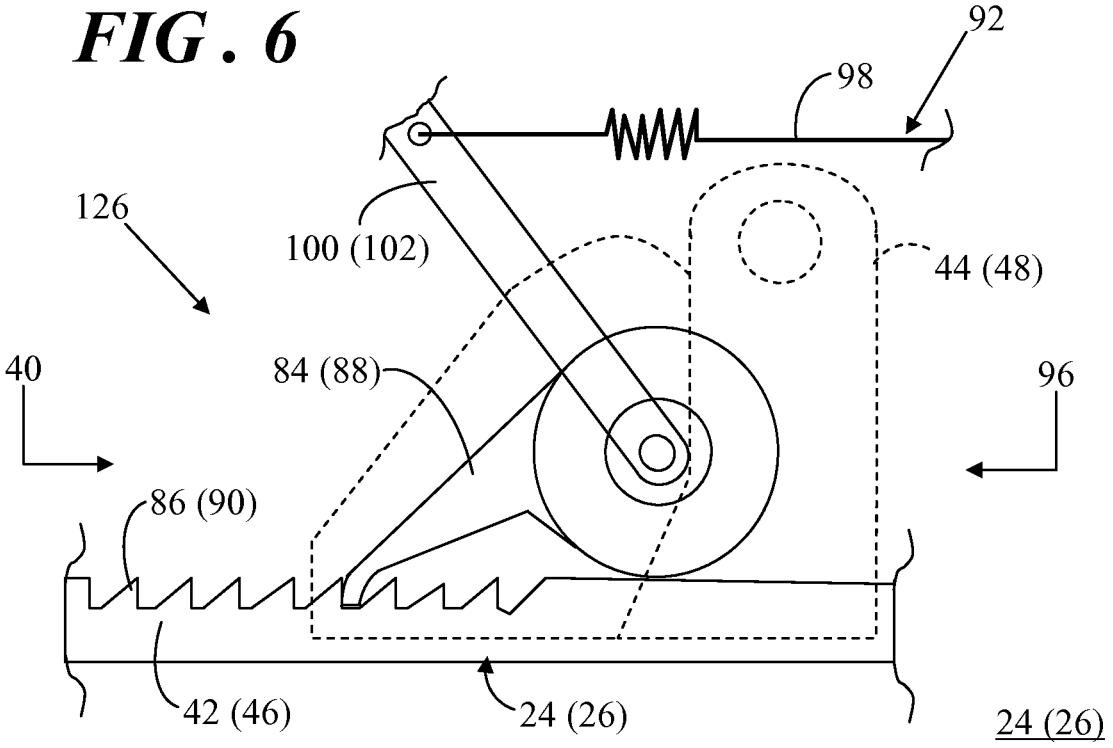
FIG. 6 shows a side diagrammatic view of a ratchet system of the support assembly in a locked position.
Figure 7:
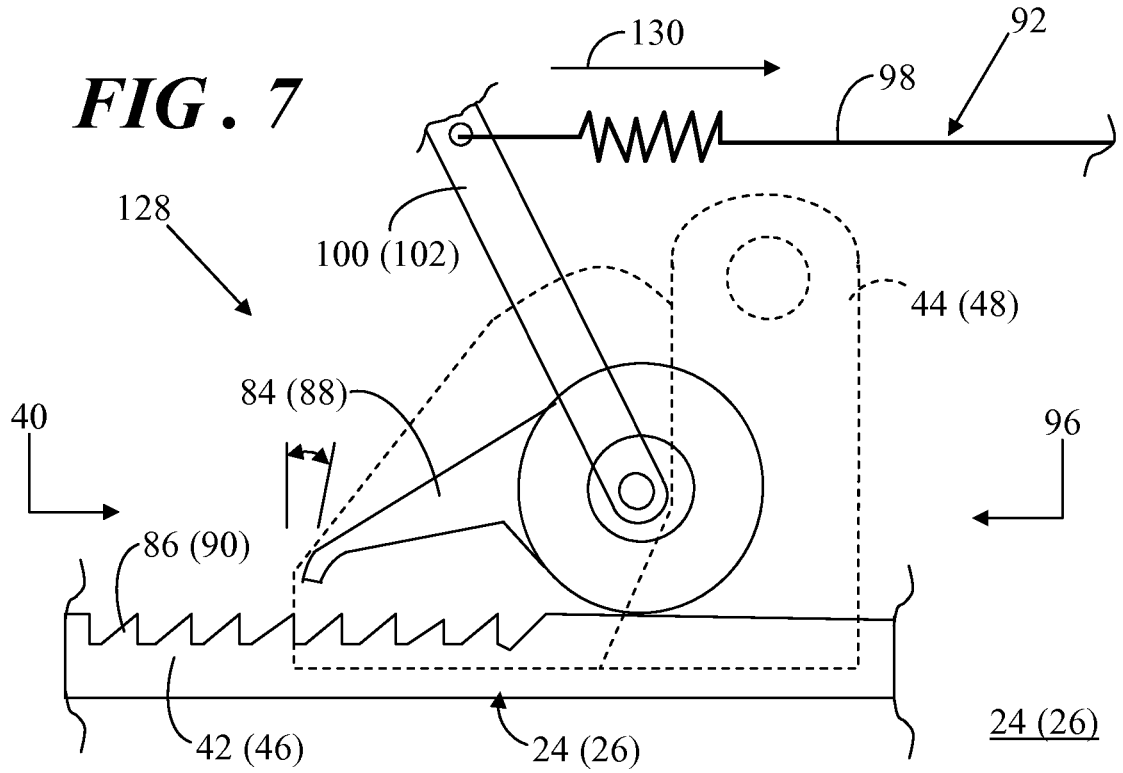
FIG. 7 shows a side diagrammatic view of a ratchet system of the support assembly in an unlocked position.

Momentarily referring to FIGS. 6 and 7 along with FIGS. 1-3, first slide structure 44 of first ratchet system 24 includes a first pawl 84 configured to engage with first teeth 86 in first linear rack 42. Likewise, second slide structure 48 of second ratchet system 26 includes a second pawl 88 configured to engage with second teeth 90 of second linear rack 46. A release mechanism 92 is coupled with each of first and second pawls 84 and 88. In an embodiment, release mechanism 92 includes a release bar 94 located at a rearward side 96 of frame 22. Release bar 94 is coupled to each of first and second pawls 84 and 88 via a pair of cable structures 98. For example, one of cable structures 98 is attached via a spring attachment to a first handle 100 coupled to first slide structure 44, and another of cable structures 98 is attached via a spring attachment to a second handle 102 coupled to second slide structure 48. A connecting bar 103 (shown in FIG. 1) is coupled to each of first and second handles 101 and 102. Attachment of handles 100 and 102 via connecting bar 103 ensures that first and second pawls 84 and 88 engage and disengage together so that a load is never applied to only one side of jack stand 20.

As will be discussed in association with FIGS. 6 and 7, first and second pawls 84 and 88, respectively, concurrently engage with successive ones of first and second teeth 86 and 90, respectively, as lift structure 28 raises and as first and second slide structures 44 and 48, respectively, slide along first and second linear racks 42 and 46, respectively. Release mechanism 92 is manually activated by a user to concurrently rotate first and second pawls 84 and 88 out of engagement with first and second teeth 86 and 90 to lower lift structure 28.

With reference back to FIGS. 1-3, jack stand 20 further includes a first wheel 104 coupled to cross member 38 of frame 22 via a first spring mechanism 106, a second wheel 108 coupled to first side member 34 via a second spring mechanism 110, and a third wheel 112 coupled to second side member 36 via a third spring mechanism 114.

Figure 4:
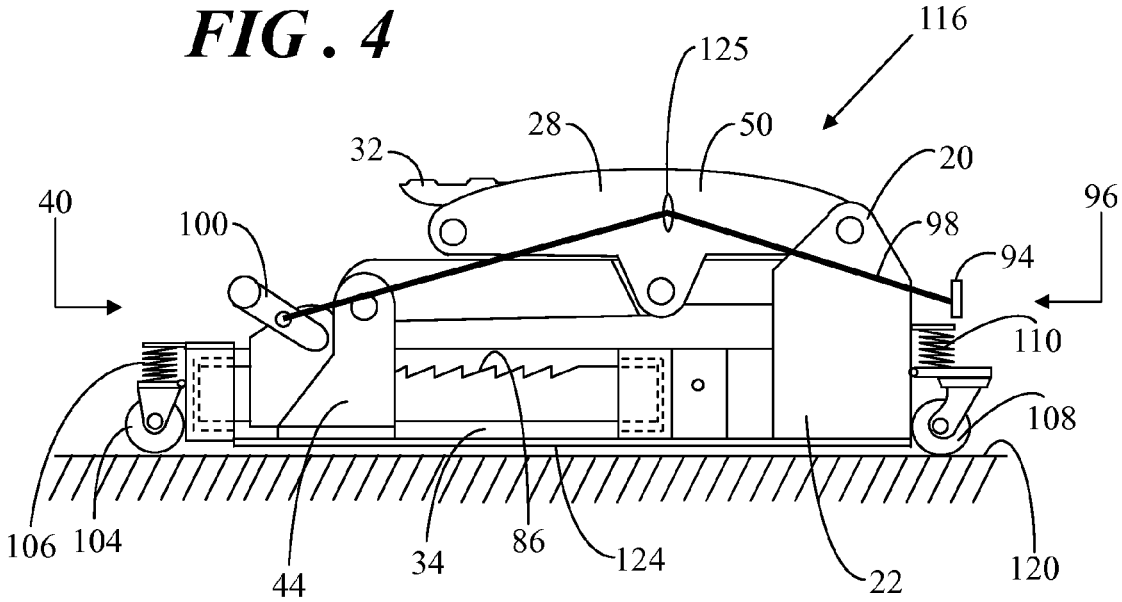
FIG. 4 shows a side view of the support assembly in a stowed position.
Figure 5:
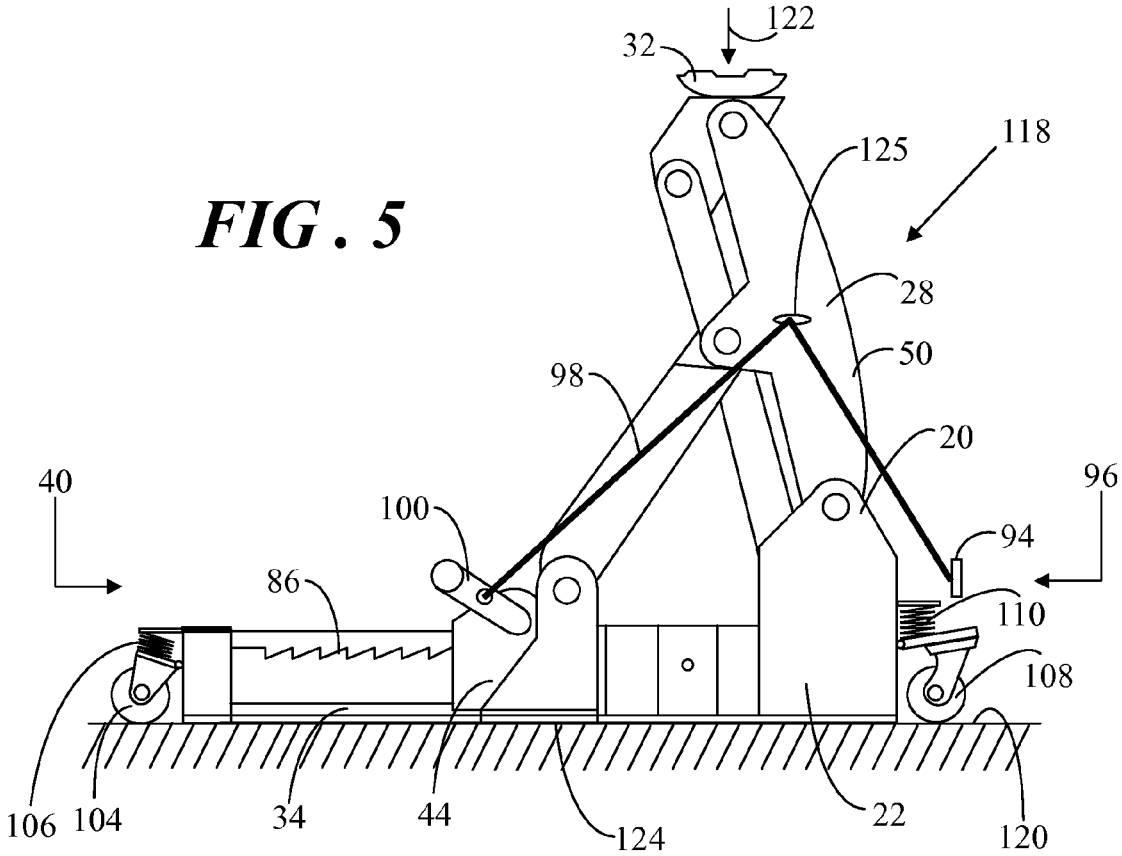
FIG. 5 shows a side view of the support assembly in an extended position.

Referring to FIGS. 4 and 5 along with FIGS. 1-3, FIG. 4 shows a side view of the support assembly, i.e., jack stand 20, in a stowed position 116, and FIG. 5 shows a side view of the support assembly, i.e., jack stand 20, in an extended position 118. In stowed position 116, the elements of frame 22 and lift structure 28 are oriented approximately horizontal, i.e., approximately parallel to an underlying surface 120, and first and second slide structures 44 and 48 are slid toward forward side 40 of frame 22. In extended position 118, the elements of frame 22 remain horizontally oriented while lift structure 28 is oriented approximately vertical relative to surface 120. Additionally, first and second slide structures 44 and 48 have slid toward rearward side 96 of frame 22 successively engaging with first and second teeth 86 and 90. As shown in FIGS. 4 and 5, cable structures 98 are routed through eyebolts 125 coupled to lift arms 50. Thus, cable structures 98 remain taught as lift structure 28 is moved between stowed position 116 and extended position 118.

As exemplified in FIG. 4, first, second, and third spring mechanisms 106, 110, and 114 include compression springs that cause frame 22 to be suspended above surface 120 when no load is applied to saddle 32 of jack stand 20 such as for example, when jack stand 20 is in stowed position 116. Thus, jack stand 20 can be readily rolled to a suitable location underneath vehicle 21. Furthermore, as shown in FIG. 5, when jack stand 20 is adjusted into extended position 118 (discussed below), contact with a portion of vehicle 21 results in a downward force 122 caused by the weight of vehicle 21 that is applied to saddle 32. Downward force 122 causes the compression springs in each of spring mechanisms 106, 110, and 114 to compress so that a bottom side 124 of frame 22 abuts, i.e., rests on, surface 120. Accordingly, once jack stand 20 is suitably positioned, jack stand 20 will be unable to roll and can safely and stably support vehicle 21.

With reference to FIGS. 6 and 7, FIG. 6 shows a side diagrammatic view of first ratchet system 24 of the support assembly, i.e. jack stand 20 (FIG. 1), in a locked position 126, and FIG. 7 shows a side diagrammatic view of first ratchet system 24 of the support assembly, i.e. jack stand 20, in an unlocked position 128. FIGS. 6 and 7 are discussed herein in connection with the elements of first ratchet system 24, in particular, first pawl 84 of first slide structure 44 and first teeth 86 of first linear rack 42. However, the following discussion applies equally to the elements of second ratchet system 26, in particular, second pawl 88 of second slide structure 48 and second teeth 90 of second linear rack 46. Accordingly, the reference numerals for second ratchet system 26, second slide structure 48, second pawl 88, second teeth 90, and second linear rack 46 are also shown in FIGS. 6 and 7 enclosed in parentheses.

First linear rack 42 is typically formed of steel plate or casting, and may be attached to first side member 34 (FIG. 1)

via welding, conventional rivet fasteners, bolts, end caps (enclosures), and the like. First teeth 86 are typically evenly spaced and can have a variety of suitable shapes. In the illustrated embodiment, first teeth 86 are inclined toward rearward side 96 of frame 22 (FIG. 2). First pawl 84 is shaped to engage with first teeth 86 of first linear rack 42 unless intentionally disengaged. The rearwardly inclined first teeth 86 and engagement of first teeth 86 by a spring mechanism allows first pawl 84 of first slide mechanism 44 to ratchet rearwardly along first linear rack 42 and successively engage with first teeth 86 as lift arms 50 (FIG. 1) of lift structure 28 (FIG. 1) are raised up.

First pawl 84 is manually disengaged from first teeth 86 via release mechanism 92 by an operator pulling on release bar 94 (FIG. 1) coupled to cable structure 98 which, in turn, is coupled to first handle 100. This manual disengagement imparts a force 130 to cause first pawl 84 to rotate out of engagement with first teeth 86 as represented by unlocked position 128 of FIG. 7.

FIG. 8 shows a side perspective view of a conventional floor jack 132. Floor jack 132 may be a conventional hydraulic jack having wheels 134 that allow it to be rolled to a suitable location. Per convention, floor jack 132 may be activated by hydraulic pressure as a long arm 136 is pumped up and down, represented by a bi-directional arrow 138. When long arm 136 is pumped up, lift arms 139 move upwardly thereby lifting a head 140 of floor jack 132 so that head 140 engages with a jacking location of a vehicle. An operator can continue to pump long arm 136 in order to lift a vehicle so that maintenance can be performed underneath the vehicle. Although a hydraulic jack is mentioned herein, it should be understood that other mechanical jack designs, such as a scissor jack, a screw thread jack, or the like, may alternatively be used.

Referring now to FIGS. 9 and 10, FIG. 9 shows a side perspective view of the support assembly, i.e., jack stand 20, in use with floor jack 132, and FIG. 10 shows an enlarged side view of a portion of bridge member 30 of the support assembly, i.e., jack stand 20, in operation with floor jack 132. In accordance with an embodiment, jack stand 20 is configured to operate cooperatively with floor jack 132 and is co-located with floor jack 132 at a desired jacking location underneath a vehicle.

Rearward side 96 of frame 22 of jack stand 20 is open. That is, a relatively large, high profile structural cross member, such as cross member 38, is absent in frame 22 at rearward side 96. However, a relatively flat cross member 141 (see FIG. 2) may be present to provide additional structural rigidity to frame 22. Thus, in operation, floor jack 132 is rolled through the open rearward side 96 of frame 22 and is positioned between first and second side members 34 and 36, respectively, of frame 22. Jack stand 20, together with floor jack 132 can then be rolled to a suitable jacking location underneath a vehicle. Next, floor jack 132 is pumped up using long arm 136 so that head 140 moves into contact with lower surface 80 of support plate 70 of bridge member 30 (best seen in FIG. 10). Support plate 70 suitably has a width 142 between first and second sidewalls 72 and 76, respectively, sized to accommodate positioning of head 140 of floor jack 132. Lift structure 28 is capable of being raised as upward force, represented by an arrow 144, is applied via head 140 of floor jack 132 to lower surface 80. That is, continued upward pumping of long arm 136 causes head 140 of floor jack 132 to rise so that head 140 pushes upwardly against bridge member 30.

Lift arms 50 of lift structure 28 raise, thus causing saddle 32 of jack stand 20 to abut an underside of vehicle 21 (FIG. 1) to be lifted. As lift arms 50 move vertically, first and second pawls 84 and 88, respectively (FIG. 6), successively engage with each of their respective first and second teeth 86 and 90 as first and second slide structures 44 and 46 slide along first and second linear racks 42 and 46. First and second pawls 84 and 88 securely lock into each successive one of first and second teeth 86 and 90 until a desired height of jack stand 20 is reached. Once the desired height is reached, floor jack 132 can be lowered so that load is transferred to jack stand 20. First, second, and third spring mechanisms 106, 110, and 114 (FIG. 1) compress under load so that bottom side 124 (FIG. 5) of frame 22 contacts surface 120 (FIG. 5) and jack stand 20 is unable to roll. Floor jack 132 can then be removed from underneath jack stand 20. Jack stand 20 will remain locked with lift structure 28 extended upwardly and holding up the vehicle. When the vehicle needs additional lift at another location, floor jack 132 can be used with another jack stand 20 to again lift the vehicle at another location in accordance with the above described procedure.

To lower the vehicle, floor jack 132 is moved back into position between first and second side members 34 and 36, respectively, of frame 22. Floor jack 132 is pumped up using long arm 136 so that head 140 moves into contact with lower surface 80 of bridge member 30. Release mechanism 92 is actuated by the operator to disengage first and second pawls 84 and 88 (FIG. 7) from respective first and second teeth 86 and 90 so that the weight of the vehicle is transferred from jack stand 20 to floor jack 132 via contact between bridge member 30 of jack stand 20 and head 140 of floor jack 132. Next, head 140 of floor jack 132 is lowered per convention which causes jack stand 20 to also lower, thus returning the vehicle to the ground. Floor jack 132 and jack stand 20 can then be removed from beneath the vehicle.

As described above, jack stand 20 is already is position at a jacking location of the vehicle as floor jack 132 lifts the vehicle. Thus, jack stand 20 and floor jack 132 can be co-located underneath, for example, a unibody vehicle that typically has a very limited number of locations at which to place a jack. Jack stand 20 can be readily rolled into place, and the spring suspension wheels 104, 108, and 112 collapse under load so that jack stand 20 cannot move once it is supporting a vehicle. The dual sliding first and second ratchet systems 24 and 26 move to provide secure engagement, while bridge member 30 and saddle 32 pivot in order to remain generally horizontal. Jack stand 20 is low profile and can be readily rolled into position, even under vehicles having low clearance between the ground and the undercarriage of the vehicle.

Figure 11:
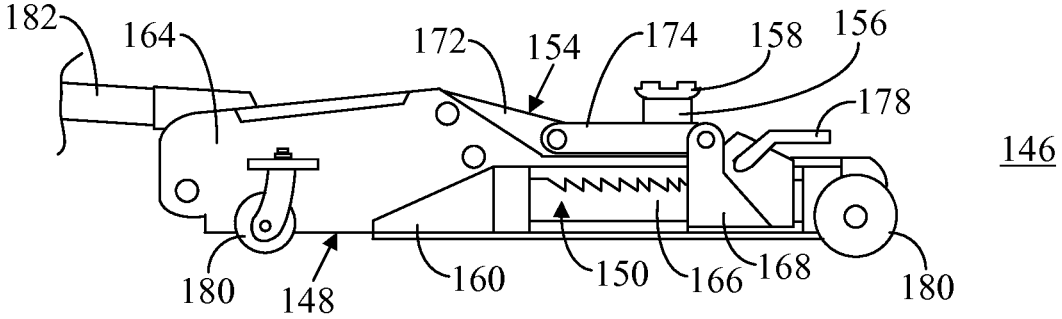
FIG. 11 shows a side view of a support assembly in the form of a floor jack in accordance with another embodiment.
Figure 12:
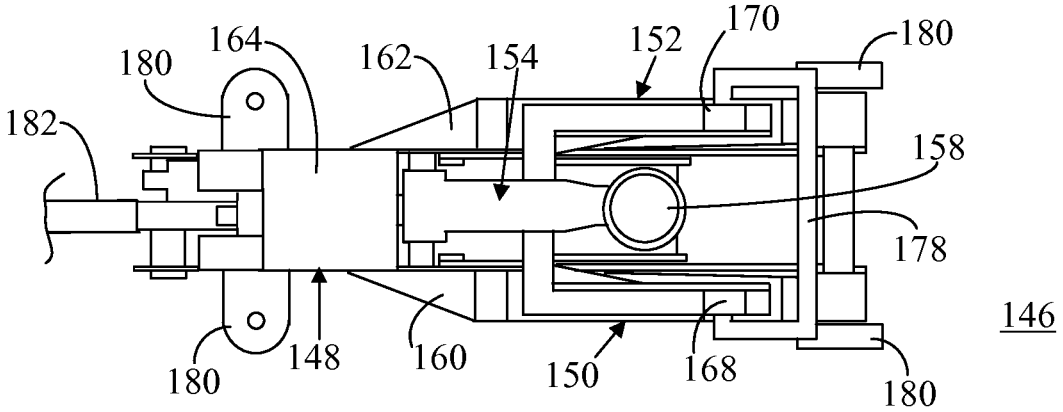
FIG. 12 shows a top view of the floor jack of FIG. 10.
Figure 13:
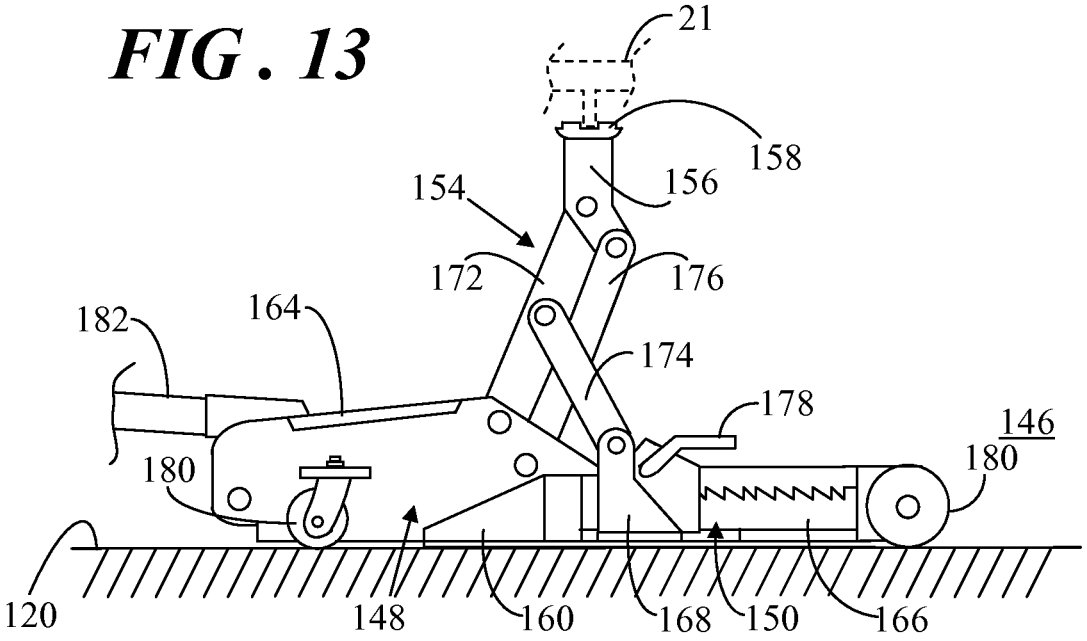
FIG. 13 shows a side view of the floor jack in an extended position.

Referring now to FIGS. 11-13, FIG. 11 shows a side view of a support assembly in the form of a floor jack 146 in accordance with another embodiment. FIG. 12 shows a top view of floor jack 146, and FIG. 13 shows a side view of floor jack 146 in an extended position. In some situations, a separate jack stand may not be called for. Instead, an operator may simply wish to use a floor jack to securely hold a vehicle in a lifted position. Floor jack 146 is a vehicle jack that may be used to raise a vehicle and support the vehicle after it has been raised. Floor jack 146 generally includes a frame 148, a first ratchet system 150, a second ratchet system 152, a lift structure 154, a bridge member 156, and a saddle 158.

Frame 148 includes a first side member 160 spaced apart from a second side member 162. First and second side members 160 and 162, respectively, are interconnected via a cross member 164. First ratchet system 150 includes a first linear rack 166 attached to and aligned with first side member 160 and further includes a first slide structure 168 slideably mounted with first side member 160. Likewise, second ratchet system 152 includes a second linear rack (not visible) attached to and aligned with second side member 162 and further includes a second slide structure 170 slideably mounted with second side member 162.

Lift structure 154 includes a pair of lift arms 172, a pair of connecting arms 174, and a pair of connecting links 176 (one of each being visible in FIG. 13). An end of each lift arm 172 is pivotally coupled to one of first and second side members 160 and 162, respectively. The other end of each lift arm 172 is pivotally coupled to bridge member 156. An end of each connecting arm 174 is pivotally coupled to one of first and second slide structures 168 and 170, respectively. The other end of each connecting arm 174 is pivotally coupled to one of lift arms 172. Connecting links 176 are oriented substantially parallel to lift arms 172. Each of connecting links 176 includes an end that is pivotally coupled to one of first and second side members 160 and 162, respectively. The other end of each connecting link 176 is pivotally coupled to bridge member 156. The arrangement and various pivotal attachments of lift arms 172, connecting arms 174, and connecting links 176 causes bridge member 156 and consequently saddle 158 to pivot and thus remain approximately horizontal as lift structure 154 moves from a stowed position (shown in FIGS. 11 and 12) to an extended position (shown in FIG. 13).

The structure and function of first and second ratchet systems 150 and 152 is equivalent to that described in connection with FIGS. 6 and 7, and thus will not be repeated herein. Similarly, floor jack 146 includes a release mechanism 178 coupled with the pawls (not illustrated) of first and second ratchet systems 150 and 152. In an embodiment, release mechanism 178 is a release bar coupled to each of pawls, again as discussed above in association with FIGS. 6 and 7. Release mechanism 178 is manually activated by a user to concurrently rotate the pawls out of engagement with teeth of first and second ratchet systems 150 and 152 to lower lift structure 154.

Typically, a floor jack required mobility (i.e., wheels) due to the circular-type motion of the saddle and lift arms (e.g., saddle 158 and lift arms 172) coming up and back drawing the floor jack in and under the load. In some applications, however, it may be desirable to limit the mobility of the floor jack. Accordingly, in an embodiment, floor jack 146 may include a set of spring suspension wheels 180 whose structure and function is similar to the wheels of jack stand 20 (FIG. 1). As such, floor jack 146 may be rolled into a suitable position underneath a vehicle, and when load is applied to saddle 158 caused by the weight of the vehicle as floor jack 146 is extended upwardly, compression springs (not shown for simplicity but represented by FIGS. 4 and 5) of each of the spring suspension wheels 180 compress so that the bottom side of frame 148 of floor jack 146 rests on the underlying surface 120. Thus, wheels 180 are unable to roll and floor jack 146 can stably support the vehicle in a lifted position. However, such a structural configuration can only be used in front or rear applications where floor jack 146 is generally parallel to the vehicle's wheels. In this position, the vehicle is allowed to move slightly toward floor jack 146 as floor jack 146 is raised.

In an embodiment, floor jack 146 may be activated by pumping a long arm 182 of floor jack 146. When long arm 182 is pumped up, lift arms 172 move upwardly thereby lifting saddle 158 of floor jack 146 so that saddle 158 engages with a jacking location of a vehicle. An operator can continue to pump long arm 182 in order to lift a vehicle. The pawls (not shown) of first and second ratchet systems 150 and 152 engage with each of their respective teeth in the linear racks, of which only first linear rack 166 is visible. The pawls securely lock into each successive tooth until a desired height of floor jack 146 is reached. Floor jack 146 will remain locked with lift structure 154 extended upwardly and holding up the vehicle. To lower the vehicle, release mechanism 178 is actuated by the operator to disengage the pawls (not shown) from their respective teeth. Next, saddle 158 of floor jack 146 is lowered per convention, thus returning the vehicle to the ground. Floor jack 146 can then be removed from beneath the vehicle.

Floor jack 146 can be readily rolled into place, and the spring suspension wheels 180 collapse under load so that floor jack 146 cannot move once it is supporting a vehicle. The dual sliding first and second ratchet systems 150 and 152 move to provide secure engagement, while bridge member 156 and saddle 158 pivot in order to remain generally horizontal. Floor jack 146 is low profile and can be readily rolled into position, even under vehicles having low clearance between the ground and the undercarriage of the vehicle.

In summary, embodiments entail support assemblies for use when a portion of a vehicle is to be raised. In one embodiment the support assembly is a jack stand that functions cooperatively with a conventional vehicle jack. That is, the jack stand and a conventional vehicle jack can be co-located underneath, for example, a unibody vehicle that typically has a very limited number of locations at which to place a jack. In another embodiment, the support assembly is a floor jack. The jack stand and the floor jack each include dual sliding ratchet systems that provide secure engagement when they are in an extended position. The jack stand and the floor jack can additionally include a spring-loaded wheel system so that they can be rolled into position, and then collapse under load so that the jack stand or, alternatively, the floor jack, cannot roll once it is supporting the weight of the vehicle. Yet another embodiment entails a method of raising a portion of a vehicle using the jack stand.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A support assembly comprising:

a frame having a first side member spaced apart from a second side member, said first and second side members being interconnected via a cross member oriented approximately orthogonal to said first and second side members;

a ratchet having a linear rack attached to and aligned with said first side member and a slide structure slideably mounted with said first side member, said slide structure including a pawl configured to engage with teeth in said linear rack;

a lift structure having a bottom end pivotally coupled with said slide structure and having a top end;

a bridge member pivotally coupled with said top end of said lift structure, said bridge member having a lower surface and an upper surface; and a saddle coupled to said upper surface of said bridge member and configured to abut a portion of a vehicle to be lifted.

2. A support assembly as claimed in claim 1 wherein said lift structure raises as said pawl successively engages with each of said teeth in said linear rack.

3. A support assembly as claimed in claim 1 wherein said ratchet is a first ratchet, said linear rack is a first linear rack, said pawl is a first pawl, said teeth are first teeth, and said support assembly further comprises a second ratchet, said second ratchet including:

a second linear rack attached to and aligned with said second side member; and a second slide structure slideably mounted with said second side member, said second slide structure including a second pawl configured to engage with second teeth in said second linear rack.

4. A support assembly as claimed in claim 3 wherein said lift structure comprises:

a pair of lift arms, each of said lift arms having a first end and a second end, with each said first end pivotally coupled to one of said first and second side members, and each said second end pivotally coupled to said bridge member;

a pair of connecting arms, each of said connecting arms having a third end and a fourth end, with each said third end pivotally coupled to one of said first and second slide structures and each said fourth end pivotally coupled at a pivot point to one of said lift arms; and a pair of connecting links arranged substantially parallel to said pair of lift arms, each of said connecting links having a fifth end and a sixth end, with each said fifth end pivotally coupled to said one of said first and second side members, and each said sixth end pivotally coupled to said bridge member.

5. A support assembly as claimed in claim 3 wherein:

said first and second pawls concurrently engage with respective ones of said first and second teeth as said lift structure raises; and said support assembly further comprises a release mechanism coupled with each of said first and second pawls for concurrently rotating said first and second pawls out of engagement with said respective ones of said first and second teeth to lower said lift structure.

6. A support assembly as claimed in claim 1 wherein said support assembly is configured to operate cooperatively with a floor jack, said cross member of said frame is located at a forward side of said frame and a rearward side of said frame is open so that said floor jack is able to be positioned between said first and second side members of said frame with a head of said floor jack in contact with said lower surface of said bridge member.

7. A support assembly as claimed in claim 1 wherein:

said first side member and said linear rack are oriented approximately parallel to a surface upon which said support assembly resides;

said lower surface of said bridge member is configured to accommodate a head of a floor jack;

said lift structure is capable of being raised and lowered as force is applied via said head of said floor jack to said lower surface of said bridge member; and said pawl successively engages with each of said teeth in said linear rack as said lift structure is raised.

8. A support assembly as claimed in claim 7 wherein said bridge member comprises:

a support plate having said upper and lower surfaces;

a first sidewall downwardly extending from a front edge of said support plate; and a second sidewall downwardly extending from a rear edge of said support plate, wherein said support plate has a width between said first and second sidewalls sized to accommodate positioning of said head of said floor jack between said first and second sidewalls.

9. A support assembly as claimed in claim 1 further comprising wheels, each of said wheels being coupled to said frame via a spring suspension mechanism such that said frame is suspended above a surface, and when a downward force is applied to said saddle, said spring suspension mechanism compresses so that a bottom side of said frame rests on said surface.

10. A support assembly as claimed in claim 9 wherein:

said cross member of said frame is located at a forward side of said frame;

a first one of said wheels is coupled via a first spring mechanism to said cross member;

a second one of said wheels is coupled via a second spring mechanism to said first side member; and a third one of said wheels is coupled via a third spring mechanism to said second side member.

11. A support assembly as claimed in claim 1 wherein:

said first and second side members and said linear rack are oriented approximately horizontal; and said lift structure is configured to raise in an approximately vertical direction.

12. A method of raising a portion of a vehicle comprising:

placing a support assembly beneath a portion of said vehicle, said support assembly including:

a frame having a first side member spaced apart from a second side member, said first and second side members being interconnected via a cross member oriented substantially orthogonal to said first and second side members;

a first ratchet having a first linear rack attached to and aligned with said first side member and a first slide structure slideably mounted with said first side member, said first slide structure including a first pawl configured to engage with first teeth in said first linear rack;

a lift structure having a bottom end pivotally coupled with said first slide structure and having a top end;

a bridge member pivotally coupled with said top end of said lift structure, said bridge member having a lower surface and an upper surface; and a saddle coupled to said upper surface of said bridge member; and applying force to said bridge member to raise said lift structure and move said saddle into contact with said portion of said vehicle, wherein said first pawl successively engages with each of said first teeth in said first linear rack as said lift structure raises.

13. A method as claimed in claim 12 wherein said cross member of said frame is located at a forward side of said frame, a rearward side of said frame is open, and said method further comprises:

providing a floor jack;

directing said floor jack through said rearward side of said frame to position said floor jack between said spaced apart first and second side members;

adjusting said floor jack so that a head of said floor jack contacts said lower surface of said bridge member;

extending said floor jack to apply said force to said bridge member and elevate said portion of said vehicle to a desired elevation;

lowering said floor jack, wherein said pawl remains engaged with one of said teeth when said floor jack is lowered and said saddle resides contact with said portion of said vehicle; and removing said floor jack.

14. A method as claimed in claim 12 wherein said support assembly further includes a second ratchet having a second linear rack attached to and aligned with said second side member, and a second slide structure slideably mounted with said second side member, said second slide structure including a second pawl configured to engage with second teeth in said second linear rack, and wherein said applying operation causes said first and second pawls to concurrently engage with respective ones of said first and second teeth as said lift structure raises.

15. A support assembly comprising:

a frame having a first side member spaced apart from a second side member, said first and second side members being interconnected via a cross member oriented approximately orthogonal to said first and second side members;

a first ratchet having a first linear rack attached to and aligned with said first side member and a first slide structure slideably mounted with said first side member, said first slide structure including a first pawl configured to engage with first teeth in said first linear rack;

a second ratchet having a second linear rack attached to and aligned with said second side member and a second slide structure slideably mounted with said second side member, said second slide structure including a second pawl configured to engage with second teeth in said second linear rack, wherein said first and second side members and said first and second linear racks are oriented approximately parallel to a surface upon which said support assembly resides;

a lift structure having a bottom end pivotally coupled with said first and second slide structures and having a top end, said lift structure being configured to raise in an approximately vertical direction;

a bridge member pivotally coupled with said top end of said lift structure, said bridge member having a lower surface and an upper surface; and a saddle coupled to said upper surface of said bridge member and configured to abut a portion of a vehicle to be lifted.

16. A support assembly as claimed in claim 15 wherein said lift structure comprises:

a pair of lift arms, each of said lift arms having a first end and a second end, with each said first end pivotally coupled to one of said first and second side members, and each said second end pivotally coupled to said bridge member;

a pair of connecting arms, each of said connecting arms having a third end and a fourth end, with each said third end pivotally coupled to one of said first and second slide structures and each said fourth end pivotally coupled at a pivot point to one of said lift arms; and a pair of connecting links, each of said connecting links having a fifth end and a sixth end, with each said fifth end pivotally coupled to said one of said first and second side members, and each said sixth end pivotally coupled to said bridge member.

17. A support assembly as claimed in claim 15 wherein:

said first and second pawls concurrently engage with respective ones of said first and second teeth as said lift structure raises; and said support assembly further comprises a release mechanism coupled with each of said first and second pawls for concurrently rotating said first and second pawls out of engagement with said respective ones of said first and second teeth to lower said lift structure.

18. A support assembly as claimed in claim 15 wherein said support assembly is configured to operate cooperatively with a floor jack, said cross member of said frame is located at a forward side of said frame and a rearward side of said frame is open so that said floor jack is able to be positioned between said first and second side members of said frame with a head of said floor jack in contact with said lower surface of said bridge member.

19. A support assembly as claimed in claim 15 wherein said lower surface of said bridge member is configured to accommodate a head of a floor jack, said lift structure is capable of being raised and lowered as force is applied via said head of said floor jack to said lower surface of said bridge member, and said first and second pawls concurrently engage with respective ones of said first and second teeth as said lift structure raises.

20. A support assembly as claimed in claim 15 further comprising wheels, each of said wheels being coupled to said frame via a spring suspension mechanism such that said frame is suspended above a surface, and when a downward force is applied to said saddle, said spring suspension mechanism compresses so that a bottom side of said frame rests on said surface.

* * * * *